United States Patent [19]

Drappel et al.

[11] Patent Number: 4,880,720

[45] Date of Patent: Nov. 14, 1989

[54] LIQUID DEVELOPER COMPOSITIONS

[75] Inventors: Stephan Drappel, Toronto; Raymond W. Wong, Mississauga; Melvin D. Croucher, Oakville, all of Canada

[73] Assignee: Xerox Corporation, Stamford, Conn.

[21] Appl. No.: 197,132

[22] Filed: May 23, 1988

[51] Int. Cl.[4] ..... G03G 9/12

[52] U.S. Cl. ..... 430/115; 430/45

[58] Field of Search ..... 430/45, 115

[56] References Cited

U.S. PATENT DOCUMENTS

| | | | |
|---|---|---|---|
| 3,013,890 | 12/1961 | Bixby . | |
| 3,793,205 | 2/1974 | Metcalfe et al. . | |
| 3,850,830 | 11/1974 | Fukushima et al. | 430/115 X |
| 4,078,929 | 3/1978 | Gundlach . | |
| 4,264,185 | 4/1981 | Ohta | 355/4 |
| 4,312,932 | 1/1982 | Hauser et al. | 430/45 |
| 4,476,210 | 10/1984 | Croucher et al. | 430/114 |
| 4,500,616 | 2/1985 | Haneda et al. | 430/45 |
| 4,524,117 | 6/1985 | Maekawa et al. | 430/44 |
| 4,686,163 | 8/1987 | Seuing et al. | 430/47 |

FOREIGN PATENT DOCUMENTS

| | | |
|---|---|---|
| 1225049 | 3/1976 | Fed. Rep. of Germany . |
| 2169416A | 7/1980 | United Kingdom . |

*Primary Examiner*—Roland E. Martin

*Attorney, Agent, or Firm*—Judith L. Byorick

[57] ABSTRACT

Disclosed is an electrophotographic liquid developer composition comprising a liquid medium, first toner particles charged to one polarity and comprising a resin and a first pigment, second toner particles charged to a polarity opposite to that of the first toner particles and comprising a resin and a second pigment of a color different from that of the first pigment, and a charge director. The disclosed developer is suitable for developing electrostatic latent images in two different colors in a single development step. The latent image comprises three areas of charge; toner particles of one color are selectively attracted to one area, toner particles of the other color are selectively attracted to the second area, and the third area remains undeveloped as a background area.

37 Claims, No Drawings

LIQUID DEVELOPER COMPOSITIONS

BACKGROUND OF THE INVENTION

The present invention is directed to a liquid developer composition especially suitable for generating two-color images. More specifically, the present invention is directed to a developer useful, for example, in a process wherein electrostatic latent images formed on the surface of an imaging member are developed in a single step with a liquid developer containing first and second toner particles of opposite polarities, wherein the first and second toner particles are of different colors.

Electrophotographic image formation wherein a two-color image is developed in a single step can be performed either with a dry developer or with a liquid developer. With a dry developer, the latent image may be developed in a single step with a developer composition wherein toner particles of opposite charge and different colors are present in a developer housing, and toner particles of each color are selectively attracted to different portions of the latent image to result in a two-color developed image. Development of two-color images according to this process and with a liquid developer functions in a similar manner. One problem, however, that arises with the liquid developers relates to the colloidal stability of the developer composition. When a liquid medium contains toner particles of two different colors and opposite polarities, the particles will tend to attract each other to form particle agglomerations or aggregates with no net charge. Since the agglomerations or aggregates are essentially neutral with respect to charge, development is difficult or substantially nonexistent, since the mutual attraction between the particles is greater than the attraction between the particles and the portions of the latent image with opposite polarity.

Accordingly, a major difficulty in formulating liquid developers suitable for developing two-color images in a single step or pass is the preparation of a colloidally stable developer composition, wherein the oppositely charged toner particles do not agglomerate or aggregate to an extent that renders development difficult or impossible, or that results in poor quality images. The developer compositions of the present invention are intended to overcome this difficulty. One embodiment of the present invention comprises an electrophotographic developer composition comprising a liquid medium, first toner particles charged to one polarity and comprising a resin and a first pigment of one color, second toner particles charged to a polarity opposite to that of the first toner particles and comprising a resin and a second pigment of a color different from that of the first pigment, and a charge director.

Methods of generating two-color electrophotographic images are known. For example, U.S. Pat. No. 4,264,185, the disclosure of which is totally incorporated herein by reference, discloses an apparatus for developing images of two different colors. The apparatus of this patent is used in a development process wherein an electrostatic latent image of two different polarities is created on the imaging member and dry toner particles of opposite polarities, which are kept in two separate housings, are applied to the bipolar latent image for development. Preferably, the two toners are applied sequentially; in all instances, the two toners must be kept separate to prevent them from attracting each other such that their opposite charges are neutralized and both toners become incapable of developing latent images.

Another reference, U.S. Pat. No. 4,500,616, the disclosure of which is totally incorporated herein by reference, also discloses a method for developing two-color images with dry toner. According to this method, images of both positive and negative polarities are generated on a two-layered imaging member by means of a multi-stylus electrode, followed by development with two toners of different colors and opposite polarity. These two toners are mixed together to form one complex developer composition, and each image is developed under a magnetic bias by a process wherein the toner of one polarity is selectively extracted from a second toner of opposite polarity in the presence of an alternating field. This patent is directed to an imaging method employing multiple pass development.

U.S. Pat. No. 4,524,117, the disclosure of which is totally incorporated herein by reference, also directed to a multiple pass development method, discloses a method for the formation of two-colored image simultaneously. The method comprises uniformly charging a photoreceptor having a photoconductive layer sensitive to a first color, exposing a two-colored original to form on the photoconductive layer a latent image corresponding to a second color region in the original with the same polarity as the electric charges on the surface of the photoconductive layer, subjecting the photoreceptor to reversal development treatment by the use of a photoconductive color toner charged with the same polarity as the electric charges constituting the latent image to develop the non-charged region with the photoconductive color toner, subjecting the latent image to a normal development treatment by the use of an insulative toner having a color different from the color of the photoconductive color toner, and charging the color toners on the photoconductive layer with a different polarity from the charging polarity and simultaneously exposing the original through a filter shielding against the first color, thereby forming a two-colored image corresponding to the original. Methods for developing two-color images from latent images of positive and negative polarities by exposing them to two toners of different color and opposite polarity are also disclosed in Japanese Patent No. 56-87061 and Japanese Patent No. 58-48065.

In addition, U.S. Pat. No. 3,013,890, the disclosure of which is totally incorporated herein by reference, discloses a method of producing two-color images in which a charge pattern is developed with a single, two-color dry developer. The developer comprises toner particles of two different colors and opposite polarities and a single carrier capable of supporting both positively charged toner particles and negatively charged toner particles. According to this method, positively charged areas are developed with the negative toner particles and negatively charged areas are developed with the positive toner particles. When the charge pattern includes both positive and negative polarities, a two-color image results. Further, U.S. Pat. No. 4,312,932, the disclosure of which is totally inorporated herein by reference, discloses a color dry developing composition which obtains color images utilizing a single pass xerographic imaging system. The composition comprises toner resin particles containing up to four pigments and a single carrier. Corona charging may be used as a method of charging.

Liquid electrophotographic developers are also known. For example, Netherlands Patent No. 6,919,431 discloses a liquid electrophotographic developer containing a plurality of first particles and a plurality of second particles suspended in a liquid carrier medium. The first particles are electrical insulators, while the second particles have a tendency to assume the polarity of the field of the image. The first particles also tend to adhere to the surface of the image, while the second particles tend to be repelled, which leads to uniform development and no depositing of developer in non-image areas.

German Patent No. 1,225,049 discloses a process for producing a liquid electrophotographic developer by dispersing two oppositely charged toners in a carrier liquid, characterized in that two oppositely charged toners are used and their particles agglomerate to result in a composite particle of reduced charge. In the composite particles thus formed, one part has a positive charge and the other part has a negative charge. The resultant charge depends on which part has the greater charge; in any case, the resultant charge on the composite particle is lower than the individual charges on the original particles. The process disclosed by this patent yields a developer from which a larger number of toner particles are deposited on the latent image than with developers not containing composite particles, which results in improved image density.

Japanese Patent No. 55-124156 discloses a method for developing two-color images with a liquid developer. The developer composition comprises two kinds of insulating liquids of different specific gravities that do not mix with or dissolve in each other, such that two separate phases exist in the solution. One toner is contained in the first liquid, and another toner of different color and opposite polarity with respect to the first toner is contained in a second liquid. Since the liquids maintain separate phases, the two toners of opposite polarities do not attract each other.

Another reference, U.S. Pat. No. 3,793,205, discloses a developer composition comprising an insulating carrier liquid, a developer pigment of one polarity, and a second developer medium of opposite polarity to the first. The second developer medium enhances the deposition of the first pigment onto the imaging areas by increasing its sensitivity and allowing it to be deposited more heavily. The second developer medium also shields non-imaging background areas from visible contamination.

British Patent Application No. 2,169,416A discloses a liquid developer composition comprising toner particles associated with a pigment dispersed in a nonpolar liquid, wherein the toner particles are formed with a plurality of fibers of tendrils from a thermoplastic polymer. This application also discloses a process for preparing the disclosed liquid developer. In addition, U.S. Pat. No. 4,476,210 discloses a liquid developer composition and a method of making the developer, which developer comprises a marking particle dispersed in an aliphatic dispersion medium, wherein the marking particle comprises a thermoplastic resin core having an amphipathic block or graft copolymeric steric stabilizer irreversibly chemically or physically anchored to the thermoplastic resin core, with the dye being imbibed in the resin core and being soluble therein and insoluble in the dispersion medium.

Copending application U.S. Ser. No. 197,130, now U.S. Pat. No. 4,830,945, the disclosure of which is totally incorporated herein by reference, also discloses a developer suitable for a process wherein electrostatic latent images formed on the surface of an imaging member are developed in a single step with a liquid developer containing a plurality of first toner particles and a plurality of second toner particles, wherein the first and second toner particles are of opposite polarities and different colors. The developer comprises a liquid medium, first toner particles charged to one polarity which comprise a first dye of one color and polymeric cores to which steric stabilizer polymers have been attached, second toner particles charged to a polarity opposite to that of the first toner particles which comprise a second dye of a color different from the color of the first dye and polymeric cores to which steric stabilizer polymers have been attached, and a charge director. Further, copending application U.S. Ser. No 147,131, the disclosure of which is totally incorporated herein by reference, discloses a process for generating two-color images, comprising charging an imaging member; creating on the member a latent image comprising three different levels of potential consisting of a high level of potential, an intermediate level of potential, and a low level of potential; providing an electrode having a potential within 100 volts of that of the intermediate level of potential such that an electric field is generated between the member and the electrode, thereby creating a development zone between the electrode and the imaging member; and developing the latent image by introducing into the development zone a liquid developer composition containing first toner particles of one color and second toner particles of another color, said particles being dispersed in a liquid medium, such that the second toner particles are attracted to the high level of potential and the first toner particles are attracted to the low level of potential, with the intermediate level of potential remaining undeveloped. Copending application Ser. No. 197,131 also discloses developer compositions suitable for use in the disclosed process.

The process of charging a photoresponsive imaging member to a single polarity and creating on it an image consisting of at least three different levels of potential of the same polarity is disclosed in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area, with the second and third areas functioning as image areas. The charge pattern is developed in a first step with positively charged toner particles of a first color, and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level development process in U.S. Pat. No. 4,686,163.

Latent images generated according to the process disclosed in U.S. Pat. No. 4,078,929, hereinafter referred to as tri-level images, usually cannot be developed by sequentially applying two distinct liquid developers of different color and opposite polarity to the latent images because of the nature of liquid developers. While dry toners usually acquire charge by contact with carrier beads of opposite charge, liquid toners generally acquire charge by interaction with ionizable components in the liquid. Accordingly, in dry toners, the countercharges are contained on the carrier particles and are held under control by mechanical forces, while in liquid toners the countercharges are molecularly dispersed in the liquid. Thus, when an electric field is applied to a dry developer, only the charged toner particles migrate, and the countercharges do not migrate to the latent image; when an electric field is applied to a liquid developer, however, both the charged toner particles and the countercharges dispersed in the liquid migrate under the field. When tri-level images are developed with a liquid developer, the charged toner particles develop the areas of one bias, the background areas of second bias remain undeveloped, and the countercharges contained within the liquid developer tend to neutralize the areas of the third bias. As a consequence, only a degraded image with reduced contrast potential remains to be developed by a second liquid developer containing toner particles charged oppositely to the first toner particles.

Accordingly, while the compositions and processes of the above patents are suitable for their intended purposes, a need continues to exist for improved liquid electrophotographic developers suitable for generating two-color electrophotographic images. There is also a need for liquid developers wherein first and second particles with different colors and opposite polarities are present in the same developer solution. In addition, there is a need for liquid electrophotographic developers capable of developing two-color electrophotographic images in a single step. Further, a need exists for liquid electrophotographic developers wherein first and second particles with different colors and opposite polarities are present in the same developer solution without resulting in agglomeration of the oppositely charged particles to a degree that renders subsequent development with and separation of the particles difficult or impossible. Also, a need continues to exist for liquid electrophotographic developers wherein first and second particles with different colors and opposite polarities are present in the same developer solution and wherein the same charge director is employed to charge both the positive and the negative particles.

SUMMARY OF THE INVENTION

It is an object of the present invention to provide a liquid electrophotographic developer suitable for generating two-color electrophotographic images.

It is another object of the present invention to provide a liquid developer wherein first and second particles with different colors and opposite polarities are present in the same developer solution.

It is yet another object of the present invention to provide a liquid electrophotographic developer capable of developing two-color electrophotographic images in a single step.

Another object of the present invention is to provide a liquid electrophotographic developer wherein first and second particles with different colors and opposite polarities are present in the same developer solution without resulting in agglomeration of the oppositely charged particles to a degree that renders subsequent development with and separation of the particles difficult or impossible.

Yet another object of the present invention is to provide a liquid electrophotographic developer within first and second particles with different colors and opposite polarities are present in the same developer solution and wherein the particles are colloidally stable in that they do not aggregate as a result of charge attraction.

Still another object of the present invention is to provide a liquid electrophotographic developer wherein first and second particles with different colors and opposite polarities are present in the same developer solution, and wherein the same charge director is employed to charge both the positive and the negative particles.

It is a further object of the present invention to provide a liquid electrophotographic developer suitable for use in a tri-level process for generating two-color electrophotographic images, wherein the photosensitive imaging member is charged to a single polarity and the latent image consists of a high level of potential and a low level of potential, and the background areas consist of an intermediate level of potential.

Another object of the present invention is to provide liquid developer compositions suitable for use in a tri-level imaging process for generating two-color electrophotographic images.

Yet another object of the present invention is to provide liquid developer compositions suitable for use in a tri-level process for generating two-color electrophotographic images wherein the developer compositions comprise first and second particles of different colors and opposite polarities.

These and other objects of the invention are achieved by providing an electrophotographic liquid developer composition comprising a liquid medium, first toner particles charged to one polarity and comprising a resin and a first pigment, second toner particles charged to a polarity opposite to that of the first toner particles and comprising a resin and a second pigment of a different color from the first pigment, and a charge director.

Liquid developer compositions of the present invention contain first and second toner particles of opposite polarity and different colors within a liquid medium. The liquid medium functions as a low conductivity neutral medium in which the other components of the developer are uniformly dispersed. Materials suitable for the liquid medium include high purity aliphatic hydrocarbons with, for example, for 1 to about 25 carbon atoms and preferably with a viscosity of less than 2 centipoise, such as Norpar® 12, Norpar® 13, and Norpar® 15, available from Exxon Corporation, isoparaffinic hydrocarbons such as Isopar® G, H, K, L, M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Generally, the liquid medium is present in a large amount in the developer composition, and constitutes that percentage by weight of the developer not accounted for by the other components. The liquid medium is usually present in an amount of from about 80 to about 99.5 percent by weight, although the amount may vary provided that the objectives of the present invention are achieved.

The toner particles contained in the liquid developers of the present invention generally comprise composite particles of a pigment and a resin. Examples of suitable resins include polyethylene and polypropylene and their copolymers, including ethylene-vinyl acetate copolymers such as the Elvax® I resins available from E.I. DuPont Corporation, copolymers of ethylene and an α, β-ethylenically unsaturated acid selected from acrylic or methacrylic acid, where the acid moiety is present in an amount of from 0.1 to 20 percent by weight, such as the Elvax® II resins available from E.I. DuPont Corporation, chlorinated olefins such as chlorinated polypropylene, including CP-343-1, available from Eastman Kodak Company, poly-α-olefins such as polyoctadecene and polyhexadecene, and the like. Within the toner particles, the resin is generally present in an amount of from about 60 to about 95, and preferably from about 70 to about 90, percent by weight with respect to the pigment. Examples of suitable pigment materials include Raven® 5750 and Raven® 3500, available from Columbian Chemicals Company, Mogul L, available from Cabot Corporation, Regal® 330 carbon black, available from Cabot Corporation, Vulcan XC-72R, available from Cabot Corporation, Sudan Blue OS, available from Ciba-Geigy Inc., Hostaperm Pink E, available from American Hoechst Corporation, Novaperm 3010, available from American Hoechst Corporation, Lithol Rubine DCC-2734, available from Dominion Color Company, Toner 8200, available from Paul Uhlich & Company, and the like. Generally, any pigment material is suitable provided that it consists of small particles and that it combines effectively with the polymeric resin material. Pigments, however, can affect the charging characteristics of the toner particles, and a pigment of the desired color must be chosen such that it imparts to the toner particles a charge of the desired polarity and magnitude when mixed with a specific charge director. A specific pigment may result in a toner charging either positively or negatively, depending upon the charge director used. The toner particles should have an average particle diameter of from about 0.1 micron to about 10 microns, and preferably from about 0.5 to about 3 microns, as determined by a Horiba CAPA-500 centrifugal particle size analyzer, available from Horiba Instruments, Inc., Irvine, Calif., which determines average volume particle diameter. The toner particles may be present in amounts of from about 0.5 to about 8, and preferably from about 2 to about 4, percent by weight of the developer composition.

The liquid developer compositions also contain a charge control additive for the purpose of imparting a positive or negative charge to the toner particles. Charge control additives suitable for the present invention include iron naphthenate and zirconium octoate, which are available from Nuodex, lecithin, which is available from Fisher Scientific, basic barium petronate, available from Witco Chemical Company, and the like. Selected charge control agents should charge the first toner particles to one polarity and the second toner particles to the opposite polarity. The charge control additive is added to the liquid developer subsequent to formation of the toner particles in the liquid medium; the amount present is determined as a percentage by weight of the developer composition without the charge control agent present. The charge director may be present in an amount of from about 0.5 to about 10, and preferably from about 1 to about 4, percent by weight of the solids content of the developer composition without the charge control additive.

Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. Nos. 4,707,429; 4,702,984; and 4,702,985, the disclosures of each of which are totally incorporated herein by reference.

Toner particles contained in the liquid developers of the present invention are prepared by adding the resin and pigment particles, in the appropriate amounts, to an amount of the liquid medium selected for the liquid developer. Generally, the combined amounts of the resin and pigment comprise approximately 20 percent by weight of the mixture, and the liquid medium comprises about 80 percent by weight of the mixture. The resin is added to the liquid medium at room temperature in an attritor such as a Union Process Model 01 Attritor, and the mixture is then stirred as it is heated to about 110° C. When the resin has dissolved in the liquid medium, the pigment particles are added to the 110° C. mixture, and the resulting mixture is stirred for about 20 minutes in the attritor. Subsequently, the mixture is cooled to room temperature over a period of about 4 hours as it is stirred, causing the polymer to precipitate from solution to form composite particles of resin and pigment and resulting in a relatively concentrated dispersion containing the first toner particles present in an amount of about 20 percent by weight in the liquid medium. Second toner particles may then be prepared according to the same process. The particles formed are generally of from about 0.5 to about 3 microns in average diameter.

For preparing developers of the present invention containing resins insoluble in the chosen liquid medium, such as Elvax II 5720, a slightly different process is followed. The resin is added to the liquid medium as described above, and the mixture is heated to about 110° C., at which point the resin melts in the liquid medium. To the mixture of liquid medium and molten resin is added the pigment, which is intimately mixed with the resin in the attritor. The mixture is cooled to room temperature, as described above. Toner particles of the desired size, however, are not immediately obtained. The polymer-pigment composite formed as a result of the process solidifies as it is cooled, and is then broken down into particles of about 2 to about 8 microns by the attrition process; generally, the mixture is stirred in the attritor for a period of about 8 hours to obtain particles of the desired size.

Preparation of the first and second toner particles according to the aforementioned method results in two separate mixtures of toner particles in the liquid medium, each having a concentration of particles of about 20 percent by weight, wherein the particles have a charge to mass ratio of from about 80 to about 120 microcoulombs per gram. To prepare the developer compositions of the present invention, each solution of toner particles is diluted to a desired concentration by adding additional amounts of the liquid medium. Preferably, the final concentration of toner particles in the liquid medium is from about 0.5 to about 6 percent by weight, with the liquid medium being present in an amount of from about 94 to about 99.5 percent by weight. Subsequent to the dilution of each solution of toner particles, the two solutions are combined by simple mixing at ambient conditions to provide a single solution containing the first and second toner particles, with the total concentration of particles in the combined solution being from about 1 to about 12 percent by weight. The first and second toner particles of a bipolar developer of the present invention are selected so that the magnitude of the charge on the positive particles is approximately the same as the magnitude of the charge on the negative particles. After the mixture containing the first and second toner particles has been prepared, the selected charge control agent is added in the desired amount, and the mixture is then allowed to stand for at least 24 hours, resulting in a developer composition of the present invention.

The liquid developers of the present invention are suitable for use in imaging processes wherein two-color images are developed in a single step by exposing them to a single liquid developer composition contained in one development housing. One method of forming images to be developed in a single step comprises applying or "writing" areas of charge onto an imaging member in the pattern of the desired image, wherein areas to be developed in one color are formed with a charge of one polarity and areas to be developed in another color are formed with a charge of the opposite polarity.

A preferred method of forming images with the developer compositions of the present invention is the tri-level process, as described herein and in U.S. Pat. No. 4,078,929, the disclosure of which is totally incorporated herein by reference. In this process, two-color images are formed by charging an imaging member, creating on the member a latent image comprising areas of high, intermediate, and low potential, providing an electrode having a potential within about 100 volts of the intermediate potential, enabling generation of an electric field and a development zone between the electrode and the imaging member. Thereafter, the latent image is developed by introducing into the development zone a liquid developer composition of the present invention, containing first toner particles of one color and polarity and second toner particles of another color and opposite polarity, the particles being dispersed in a liquid medium, and wherein the second toner particles are attracted to the high potential and the first toner particles are attracted to the low potential, with the intermediate level of potential remaining undeveloped.

Imaging members suitable for use with tri-level development processes to form two-color images developed with the developers of the present invention may be of any type capable of maintaining three distinct levels of potential and suitable for use with liquid developers. The material of which the imaging member is formulated should be of a type that is not subject to attack by the liquid medium component of the developer. Generally, various dielectric or photoconductive insulating materials that are suitable for use in xerographic, ionographic, or other electrographic imaging processes may be used, provided that the surface is not subject to attack by the liquid medium selected for the developer composition. Suitable photoreceptor materials include selenium, selenium alloys, amorphous silicon, layered organic materials as disclosed in U.S. Pat. No. 4,265,990, the disclosure of which is totally incorporated herein by reference, and the like.

The photoresponsive imaging member may be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 200 volts, and preferably 400 volts or more. For example, a latent image on an imaging member can consist of areas of potential at 800, 400, and 100 volts. In addition, the levels of potential may consist of ranges of potential. For example, a latent image may consist of a high level of potential ranging from about 500 to about 800 volts, an intermediate level of potential of about 400 volts, and a low level ranging from 0 to about 300 volts. An image having levels of potential that range over a broad area may be created such that gray areas of one color are developed in the high range and gray areas of another color are developed in the low range, with 100 volts of potential separating the high and low ranges and constituting the intermediate, undeveloped range.

The latent image may be formed on the imaging member by any methods suitable for forming a tri-level image, such as those disclosed in U.S. Pat. No. 4,078,929, the disclosure of which is totally incorporated herein by reference, may be applied. For example, a tri-level charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a tri-level charge pattern may be formed by optically modulating light as it scans a uniformly charged photoconductive imaging member.

The electrode may be of any type suitable for use in a liquid development system. This electrode is located in the development housing, and should be located from about 0.2 millimeter to about 2 millimeters, and preferably from about 0.5 millimeter to about 0.6 millimeter from the imaging member. The electrode should be maintained at the same polarity and at a voltage close to that of the intermediate level of potential on the imaging member, preferably within 100 volts. Within the development zone created between the electrode and the imaging member, an electric field is created between the electrode and the imaging member, and the difference in potentials between the electrode and the three levels of potential on the imaging member results in the migration of the toner particles to different areas on the imaging member when the liquid developer is introduced into the development zone. Areas of high level potential on the imaging member attract toner particles of one polarity, and areas of low level potential on the imaging member attract toner particles of the other polarity. For example, in one embodiment, areas of high level potential on the imaging member attract negatively charged toner particles, since within the field created in the development zone, these areas appear positive with respect to the electrode. Areas of low level potential on the imaging member attract positively charged toner particles as within the field created in the development zone, these areas appear negative with respect to the electrode. Areas of intermediate potential remain undeveloped, since they appear neutral with respect to the electrode.

Specific embodiments of the invention will now be described in detail. These examples are intended to be illustrative, and the invention is not limited to the materials, conditions, or process parameters set forth in these embodiments. All parts and percentages are by weight unless otherwise indicated.

A. PREPARATION OF TONER PARTICLES

EXAMPLE A-1

To 1,750 grams of ¼ inch stainless steel balls present in a Union Process 01 Attritor there was added 170 grams of Isopar® G (an isoparaffinic hydrocarbon available from Exxon Corporation), and 12 grams of a poly(ethylene-co-methacrylic acid) copolymer, commercially available from E.I. DuPont Corporation as Elvax II 5720. The attritor was heated to 110° C. under constant stirring, after which 3 grams of a carbon black pigment (Mogul L, available from Cabot Corporation) was added to the mixture, and dispersion of the pigment continued for a further hour. The attritor was then cooled to 30° C. over a period of two hours. Attrition was continued for an additional four hours at 30° C. Thereafter, the attritor was discharged and the resulting black particles diluted in Isopar® G to a solids concentration of about 2 percent. The average particle diameter of the resulting toner particles was about 2.7 microns, as determined by a Horiba centrifugal analyzer.

EXAMPLE A-2

Magenta toner particles were prepared by repeating the procedure of Example A-1, with the exception that Lithol Rubine DCC-2734 was substituted for Mogul L and Isopar® L was substituted for Isopar® G. The resulting toner particles had an average particle diameter of about 2.9 microns, as determined by a Horiba centrifugal analyzer.

EXAMPLE A-3

Black toner particles were prepared by repeating the procedure of Example A-1, with the exception that Toner 8200 was substituted for Mogul L. The resulting particles had an average particle diameter of about 2.7 microns, as determined by a Horiba centrifugal analyzer.

EXAMPLE A-4

Cyan toner particles were prepared by repeating the procedure of Example A-1, with the exception that Sudan Blue OS was substituted for Mogul L. The resulting particles had an average particle diameter of about 2.7 microns, as determined by a Horiba centrifugal analyzer.

EXAMPLE A-5

Magenta toner particles were prepared by repeating the procedure of Example A-1, with the exception that Hostaperm Pink E was substituted for Mogul L. The resulting particles had an average particle diameter of about 2.8 microns, as determined by a Horiba centrifugal analyzer.

EXAMPLE A-6

Black toner particles were prepared by repeating the procedure of Example A-1, with the exception that Isopar® L was substituted for Isopar® G. The resulting particles had an average particle diameter of about 2.7 microns, as determined by a Horiba centrifugal analyzer.

EXAMPLE A-7

To 1,750 grams of ¼ inch stainless steel balls present in a Union Process 01 Attritor there was added 170 grams of Isopar® G (an isoparaffinic hydrocarbon available from Exxon Corporation), and 20 grams of a chlorinated polypropylene, commercially available from Eastman Kodak Company as CPC-343-1. The attritor was heated to 110° C. under constant stirring, after which 10 grams of a carbon black pigment (Mogul L, available from Cabot Corporation) was added to the mixture, and dispersion of the pigment continued for a further hour. The attritor was then cooled to 30° C. over a period of two hours. Attrition was continued for an additional 2 hours at 30° C. Thereafter, the attritor was discharged and the resulting black particles diluted in Isopar® G to a solids concentration of about 2 percent. The average particle diameter of the resulting toner particles was about 1.2 microns, as determined by a Horiba centrifugal analyzer.

EXAMPLE A-8

Magenta toner particles were prepared according to the procedure of Example A-7, with the exception that Hostaperm Pink E was substituted for Mogul L. The resulting toner particles had an average particle diameter of about 1.3 microns, as determined by a Horiba centrifugal analyzer.

B. PREPARATION OF BIPOLAR LIQUID DEVELOPERS

Bipolar liquid developers are prepared by mixing equal volumes of solutions containing the particles obtained from the processes of Examples A-1 to A-8 at ambient conditions and under constant stirring to form the bipolar particle mixes. Charge directors are then added to the uncharged developers and each developer is allowed to attain equilibrium for 24 hours before use. Table I below details the bipolar developers prepared, including the identity of the particles contained in the bipolar developer, the charge director employed, the charge director concentration in milligrams per gram of the solids content of the developer, and the polarity of the electrostatic charge on the particles. The particles are identified according to the example in which they were prepared; for example, Bipolar ink B-1 contains equal volumes of the solution prepared in Example A-1 and the solution prepared in Example A-2. The charge to mass ratio of the individual developers A-1 to A-8 ranges from about 80 to about 120 microcoulombs per gram.

TABLE I

| Bipolar Ink | Particles in Bipolar Ink | Charge Control Additive and Concentration | Sign of Charge on Particles |
|---|---|---|---|
| B-1 | A-1 | 25 mg/g solids iron | black-negative |
| | A-2 | naphthenate | magenta-positive |
| B-2 | A-3 | 15 mg/g solids lecithin | cyan-negative |
| | A-4 | | black-positive |
| B-3 | A-5 | 12.5 mg/g solids iron | cyan-negative |
| | A-4 | naphthenate | magenta-positive |
| B-4 | A-6 | 25 mg/g solids iron | black-negative |
| | A-2 | naphthenate | magenta-positive |
| B-5 | A-7 | 25 mg/g solids iron | black-negative |
| | A-8 | naphthenate | magenta-positive |

C. COLOR SEPARATION TESTS

Each of the bipolar developers B-1 to B-5 is tested for color separation in an electric field by plate out experiments in which a 1,500 volt potential is applied between two electrodes situated 1 centimeter apart in a solution of the bipolar developer. For each bipolar developer, after 10 seconds, a thick layer of the positive particles is formed on the negative electrode and a thick layer of the negative particles is formed on the positive electrode. The color of the particles on each of the electrodes is measured using a Spectrograd Colorimeter. These measurements are compared to the color of images prepared with each single-color particle solution prior to being mixed with the other single-color particle solution, which provides a measure of the color separation of the bipolar developer in an electric field. For example, when bipolar ink B-1 undergoes separation, the color of the positive electrode is compared to an image formed with solution A-1, and the color of the negative electrode is compared to an image formed with solution A-2. Each of the bipolar developers B-1 to B-5 undergoes particle separations of essentially 100 percent in an electric field.

D. IMAGING TESTS

Imaging tests are also performed with each of the bipolar liquid developers in a laboratory test fixture consisting of a Savin 880 copier modified to produce tri-level two-color images according to the method of U.S. Pat. No. 4,078,929. Each of developers B-1 to B-6 develops two-color images in a single development step, which images transfer from the photoreceptor to plain paper. The optical densities of images formed with this process and these developers are in excess of 1.0, indicating good transfer of the developer from the photoreceptor to plain paper.

These examples are illustrative in nature and are not intended to limit the scope of the invention. Other embodiments of the present invention may occur to those skilled in the art, and these are included within the scope of the claims.

We claim:

1. An electrophotographic liquid developer composition comprising a liquid medium, first toner particles charged to one polarity and comprising a resin and a first pigment, second toner particles charged to a polarity opposite to that of the first toner particles and comprising a resin and a second pigment different in color from the first pigment, and a charge director, wherein the first toner particles and the second toner particles are contained within the liquid medium.

2. An electrophotographic liquid developer composition according to claim 1 wherein said first toner particles and said second toner particles are from about 0.1 to about 8 microns in average volume diameter.

3. An electrophotographic developer composition according to claim 1 wherein said liquid medium is a high purity aliphatic hydrocarbon comprising from 1 to about 25 carbon atoms.

4. An electrophotographic developer composition according to claim 1 wherein said liquid medium has a viscosity of less than 2 centipoise.

5. An electrophotographic developer composition according to claim 1 wherein said liquid medium is selected from the group consisting of Isopar® G, Isopar® H, Isopar® K, Isopar® L, and Isopar® M.

6. An electrophotographic developer composition according to claim 1 wherein said first toner particles comprise a resin selected from the group consisting of copolymers of polyethylene, copolymers of polypropylene, ethylene-vinyl acetate copolymers, copolymers of ethylene and acrylic acid, copolymers of ethylene and methacrylic acid, chlorinated polyolefins, and poly-α-olefins.

7. An electrophotographic developer composition according to claim 1 wherein said first toner particles comprise a resin selected from the group consisting of poly(ethylene-co-methacrylic) acid and chlorinated polypropylenes.

8. An electrophotographic developer composition according to claim 1 wherein said second toner particles comprise a resin selected from the group consisting of polyethylene, polypropylene, copolymers of polyethylene, copolymers of polypropylene, ethylene-vinyl acetate copolymer, copolymers of ethylene and acrylic acid, copolymers of ethylene and methacrylic acid, chlorinated polyolefins, and poly-α-olefins.

9. An electrophotographic developer composition according to claim 1 wherein said second toner particles comprise a resin selected from the group consisting of poly(ethylene-co-methacrylic acid and chlorinated polypropylenes.

10. An electrophotographic developer composition according to claim 1 wherein said first toner particles and said second toner particles comprise a resin selected from the group consisting of polyethylene, polypropylene, copolymers of polyethylene, copolymers of polypropylene, ethylene-vinyl acetate copolymer, copolymers of ethylene and acrylic acid, copolymers of ethylene and methacrylic acid, chlorinated polyolefins, and poly-a-olefins.

11. An electrophotographic developer composition according to claim 1 wherein said first toner particles and said second toner particles comprise a resin selected from the group consisting of poly(ethylene-co-methacrylic) acid and chlorinated polypropylenes.

12. An electrophotographic developer composition according to claim 1 wherein said first toner particles comprise a pigment selected from the group consisting of Toner 8200, Hostaperm Pink E, and Lithol Rubine DCC-2734.

13. An electrophotographic developer composition according to claim 1 wherein said second toner particles comprise a pigment selected from the group consisting of Mogul L and Sudan Blue OS.

14. An electrophotographic developer composition according to claim 1 wherein said first toner particles comprise a pigment selected from the group consisting of Toner 8200, Hostaperm Pink E, and Lithol Rubine DCC-2734, and said second toner particles comprise a pigment selected from the group consisting of Mogul L and Sudan Blue OS.

15. An electrophotographic developer composition according to claim 1 wherein said first toner particles and said second toner particles comprise a resin present in an amount of from about 60 to about 95 percent by weight of the toner particles, and a pigment present in an amount of from about 5 to about 40 percent by weight of the toner particles.

16. An electrophotographic developer composition according to claim 1 wherein said first toner particles and said second toner particles are present in a total amount of from about 0.5 to about 8 percent by weight of the developer composition.

17. An electrophotographic developer composition according to claim 1 wherein said charge director is selected from the group consisting of iron naphthenate, lecithin, basic barium petronate, and zirconium octoate.

18. An electrophotographic developer composition according to claim 1 wherein said charge director is present in an amount of from about 0.5 to about 10 percent by weight of the solids content of the developer composition.

19. An electrophotographic developer composition according to claim 1 wherein said first toner particles are positively charged and said second toner particles are negatively charged.

20. An electrophotographic developer composition according to claim 19 wherein said first toner particles are charged to from about +80 to about +120 microcoulombs per gram, and said second toner particles are charged to from about −80 to about −120 microcoulombs per gram.

21. An electrophotographic developer composition according to claim 1 wherein said first toner particles are negatively charged and said second toner particles are positively charged.

22. An electrophotographic developer composition according to claim 21 wherein said first toner particles are charged to from about −80 to about −120 microcoulombs per gram, and said second toner particles are charged to from about +80 to about +120 microcoulombs per gram.

23. An electrophotographic liquid developer composition consisting essentially of a liquid medium, first toner particles charged to one polarity and comprising a resin and a first pigment, second toner particles charged to a polarity opposite to that of the first toner particles and comprising a resin and a second pigment different in color from the first pigment, and a charge director.

24. An electrophotographic developer composition according to claim 23 wherein said first toner particles and said second toner particles comprise a resin selected from the group consisting of polyethylene, polypropylene, copolymers of polyethylene, copolymers of polypropylene, ethylene-vinyl acetate copolymer, copolymers of ethylene and acrylic acid, copolymers of ethylene and methacrylic acid, chlorinated polyolefins, and poly-α-olefins.

25. An electrophotographic developer composition according to claim 23 wherein said first toner particles and said second toner particles comprise a resin selected from the group consisting of poly(ethylene-co-methacrylic) acid and chlorinated polypropylenes.

26. An electrophotographic developer composition according to claim 23 wherein said charge director is selected from the group consisting of iron naphthenate, lecithin, basic barium petronate, and zirconium octoate.

27. An electrophotographic developer composition according to claim 23 wherein said charge director is present in an amount of from about 0.5 to about 10 percent by weight of the solids content of the developer composition.

28. An electrophotographic developer composition according to claim 23 wherein said first toner particles and said second toner particles comprise a resin present in an amount of from about 60 to about 95 percent by weight of the toner particles and a pigment present in an amount of from about 5 to about 40 percent by weight of the toner particles.

29. An electrophotographic developer composition according to claim 23 wherein said first toner particles and said second toner particles are present in a total amount of from about 0.5 to about 8 percent by weight of the developer composition.

30. An electrophotographic developer composition according to claim 23 wherein said first toner particles and said second toner particles are from about 0.1 to about 8 microns in average volume diameter.

31. An electrophotographic liquid developer composition consisting essentially of a liquid medium, first toner particles charged to one polarity and comprising a resin and a first pigment, second toner particles charged to a polarity opposite to that of the first toner particles and comprising a resin and a second pigment different in color from the first pigment, a charge director, and a charge adjuvant.

32. An electrophotographic developer composition according to claim 1 wherein the developer also contains a charge adjuvant.

33. An electrophotographic liquid developer composition according to claim 1 wherein the first toner particles and the second toner particles contain a resin selected from the group consisting of a poly(ethylene-co-methacrylic acid) copolymer and a chlorinated polypropylene, the charge director is selected from the group consisting of lecithin and iron naphthenate, the first toner particles contain a pigment selected from the group consisting of carbon black and Sudan Blue OS, and the second toner particles contain a pigment selected from the group consisting of Lithol Rubine DCC-2734, Toner 8200, and Hostaperm Pink E.

34. An electrophotographic liquid developer composition according to claim 1 wherein the first and second toner particles contain a poly(ethylene-co-methacrylic acid) copolymer resin, the first toner particles contain a carbon black pigment, the second toner particles contain a Lithol Rubine DCC-2734 pigment, and the charge director is iron naphthenate.

35. An electrophotographic liquid developer composition according to claim 1 wherein the first and second toner particles contain a poly(ethylene-co-methacrylic acid) copolymer resin, the first toner particles contain a Toner 8200 pigment, the second toner particles contain a Sudan Blue OS pigment, and the charge director is lecithin.

36. An electrophotographic liquid developer composition according to claim 1 wherein the first and second toner particles contain a poly(ethylene-co-methacrylic acid) copolymer resin, the first toner particles contain a Hostaperm Pink E pigment, the second toner particles contain a Sudan Blue OS pigment, and the charge director is iron naphthenate.

37. An electrophotographic liquid developer composition according to claim 1 wherein the first and second toner particles contain a chlorinated polypropylene resin, the first toner particles contain a carbon black pigment, the second toner particles contain a Hostaperm Pink E pigment, and the charge director is iron naphthenate.

* * * * *